US005150491A

United States Patent [19]

Ikemoto

[11] Patent Number: 5,150,491

[45] Date of Patent: Sep. 29, 1992

[54] HAIR BRUSH

[75] Inventor: Shigeki Ikemoto, Higashi-Osaka, Japan

[73] Assignee: Ikemoto Burashi Kogyo Kabushiki Kaisha, Osaka, Japan

[21] Appl. No.: 623,420

[22] PCT Filed: May 17, 1990

[86] PCT No.: PCT/JP90/00620

§ 371 Date: Dec. 14, 1990

§ 102(e) Date: Dec. 14, 1990

[87] PCT Pub. No.: WO90/14030

PCT Pub. Date: Nov. 29, 1990

[30] Foreign Application Priority Data

May 25, 1989 [JP] Japan ..... 1-61154

[51] Int. Cl.[5] ..... A46B 9/08

[52] U.S. Cl. ..... 15/1.52; 15/159.1; 15/186; 132/219; 361/221

[58] Field of Search ..... 15/1.5 A, 159 R, 186; 134/1; 132/11 R, 219; 361/221

[56] References Cited

U.S. PATENT DOCUMENTS 3,084,700 4/1963 Fischer et al. ..... 361/221
4,083,073 4/1978 Bernardini ..... 15/1.52
4,500,939 2/1985 Gueret ..... 361/221
4,797,966 1/1989 Fong ..... 15/1.52

FOREIGN PATENT DOCUMENTS 1381068 10/1954 France ..... 15/1.52
59-29564 8/1984 Japan .
6330271 5/1986 Japan .
0090418 6/1986 Japan .
0169929 11/1988 Japan .

*Primary Examiner*—Harvey C. Hornsby
*Assistant Examiner*—Reginald L. Alexander
*Attorney, Agent, or Firm*—Sixbey, Friedman, Leedom & Ferguson

[57] ABSTRACT

A hair brush adapted to prevent charging of the bristles and hair, according to the invention, has a multiplicity of small holes (7) formed in a brush base (2) at each of widthwise opposite end portions thereof and arranged at a spacing in a row longitudinally of the base, and an antistatic member (9) is so provided as to project from the multiplicity of small holes (7) slightly beyond the base surface (2a), whereby the antistatic member (9) is made stiff and prevented from bending down, rendering the brush easy to draw through hair for smooth brushing.

10 Claims, 4 Drawing Sheets

HAIR BRUSH

TECHNICAL FIELD

The present invention relates to a hair brush adapted to prevent charging of the bristles and hair due to brushing

BACKGROUND ART

A hair brush is already known which is adapted to prevent charging of hair due to brushing so as to arrange hair satisfactorily (see Examined Japanese Utility Model Publication SHO 63-30271). This hair brush comprises a bristled portion and a handle, and the bristled portion is provided with a multiplicity of electrically conductive bristles over the surface thereof. The bristled surface has an elongated small mount aperture formed at each of its widthwise opposite ends and extending longitudinally of the surface approximately over the entire length thereof. The mount aperture has implanted therein a strip of antistatic material arranged closely continuously in the longitudinal direction and projecting to a level lower than the bristles. The antistatic material is prepared from a large number of acrylic fibers having adsorbed monovalent copper ion and incorporated therein metallic copper separated out by reduction, by spinning the fibers to obtain an arrangement of many pieces of yarn and connecting the yarn pieces together into a strip by stitching the lower portion of the arrangement.

With the conventional hair brush, the antistatic material is implanted in the elongated mount aperture at each end of the bristled surface and is as high as about one-half the height of the bristles, so that the material is low in stiffness and becomes bent down when used for a short period of time, failing to exhibit a satisfactory antistatic effect. Moreover, the antistatic material, which is arranged closely continuously in the longitudinal direction, becomes an obstacle when hair is brushed, rendering the hair brush difficult to draw through hair easily and making hair difficult to brush smoothly. The hair brush has another problem in that it is unsanitary and becomes impaired in antistatic effect since dandruff, dust or the like is trapped in the mount aperture.

An object of the present invention, which has been accomplished in view of the foregoing situation, is to provide a hair brush having a stiff antistatic member, inexpensive, sanitary and capable of fully performing an antistatic function.

DISCLOSURE OF THE INVENTION

To fulfill the foregoing object, the present invention provides the following technical means.

In a hair brush embodying the invention and comprising an electrically conductive brush base 2, a handle 4, a multiplicity of electrically conductive bristles 5 provided upright on the surface 2*a* of the brush base 2, and an antistatic member 9 made of electrically conductive fiber and provided along each of widthwise opposite end portions of the brush base surface 2*a* longitudinally of the brush base 2, a multiplicity of small holes 7 are formed in the brush base 2 at each widthwise end portion thereof and arranged at a spacing in a row longitudinally of the base, the antistatic member 9 being so provided as to project from the multiplicity of small holes 7 slightly beyond the surface 2*a*.

When the brush of the invention having the above construction is used, causing the friction between the bristles 5 and hair to charge the bristles 5 and the hair, the static charge acquired by the bristles 5 is conducted through the grounding piece 6 provided on the handle 4, while the static charge acquired by the hair is allowed access to and/or conducted to the antistatic member 9 made of conductive fiber to effectively cause corona discharge between the antistatic member 9 and the hair, whereby the charge on the hair can be neutralized smoothly. Since the antistatic member 9 is projected from the small holes 7 beyond the surface 2*a* by only a small length required for the corona discharge, hair can be brushed without any trouble. Furthermore, the brush is sanitary since dandruff or dust will not be trapped in the small holes 7. The antistatic member is stiff, will not bend down, therefore retains the contemplated antistatic function and permits satisfactory hair brushing.

Further according to the present invention, a barlike grounding piece 6 extends from longitudinal one end of the brush base, and the handle 4 is formed with a dovetail groove 17 corresponding to the grounding piece 6, the grounding piece 6 being fitted in the dovetail groove 17 so as to be exposed at the surface of the handle 4.

When the brush of the above construction is used for brushing hair, the handle 4 of the brush 1 is gripped with the hand, with the grounding piece 6 held in contact with the finger. The static electricity acquired by the bristles 5 owing to the friction between the bristles 5 and the hair can then be smoothly released through the grounding piece.

Further according to the invention, a mount 3 is provided with engaging walls 15, 16 at its respective ends opposite to each other longitudinally thereof, and the conductive brush base 2 is fitted in the space between the engaging walls 15, 16. A fitting ridge 12 is provided at each of the widthwise outer ends of the conductive brush base 2, and the mount 3 is formed in its surface with a groove 18 corresponding to the ridge 12, the ridge 12 being fitted in the groove 18.

Because of the above feature, the brush base 2 and the handle 4 can be assembled easily merely by fitting the brush base 2 into the space between the engaging walls 15, 16 of the mount 3 with the fitting ridges 12 fitted in the respective grooves 18.

BRIEF DESCRIPTION OF THE DRAWINGS

The drawings show an embodiment of the present invention.

BEST MODE OF CARRYING OUT THE INVENTION

Figure 1:
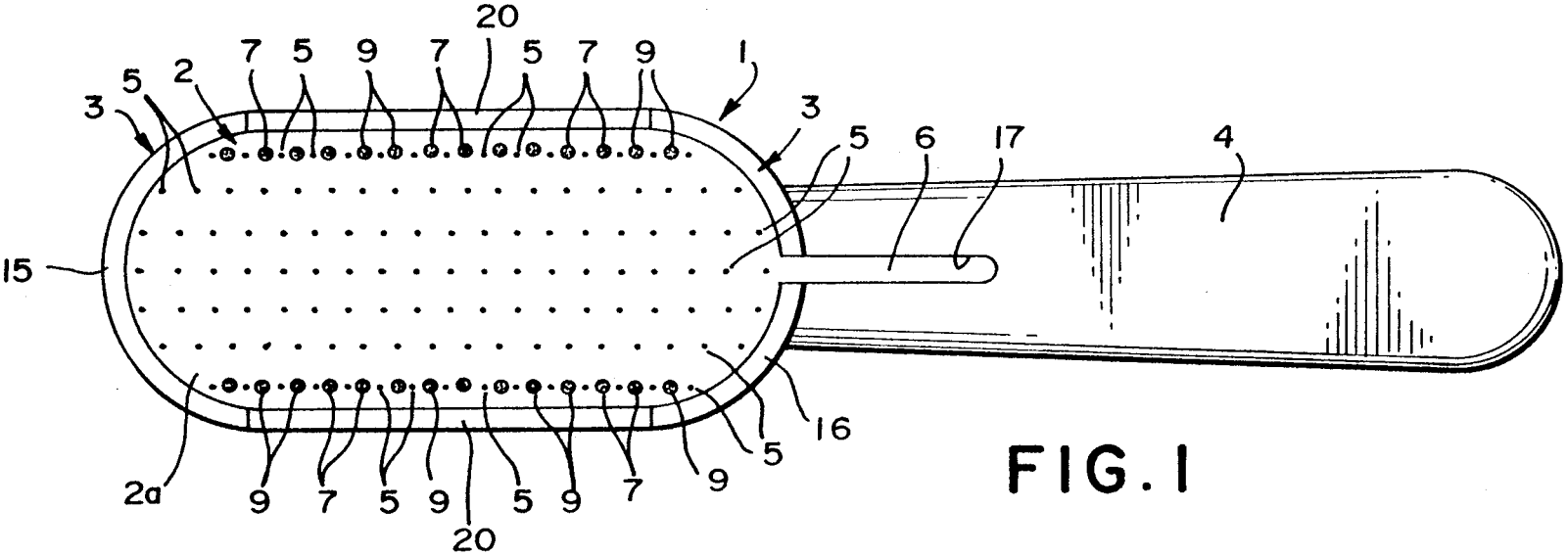
FIG. 1 is a plan view.

An embodiment of the present invention will be described below with reference to the drawings.

Referring to the drawings, indicated at 1 is a brush comprising a brush base 2, and a handle 4 having a mount 3 for the base 2. The brush base 2 is removably attached to the handle 4.

The brush base 2 is integrally molded of a material prepared by admixing carbon with a synthetic resin such as polyester elastomer and has bristles 5 provided upright on its surface 2*a* as if by implanting as seen in FIGS. 3 to 7. A barlike grounding piece 6 trapezoidal in cross section extends from the midportion of longitudinal one end of the base. Small holes 7 for an antistatic member to fit in are formed in the brush base at each of its widthwise end portions and arranged between the bristles 5 aligned along the end. The small holes 7 communicate at the rear side thereof with an elongated groove 8 for accommodating the antistatic member. The bristles 5 may be made separately from the base.

The antistatic member 9, to be described later, is fitted in the groove 8. A barlike fixing member 10 is inserted between the inner wall defining the groove 8 and the antistatic member 9 to fix the member 9. The wall faces opposed to each other widthwise of the groove 8 and defining the groove are provided with a plurality of projections 11 extending depthwise of the groove and semicircular in cross section to tightly and effectively fix the antistatic member 9 in place. A fitting ridge 12 is formed on the base at the widthwise outer side of each groove 8. Between the two grooves 8, two grooves 13 are formed in parallel to provide a fitting ridge 14 between the grooves 13.

Figure 2:
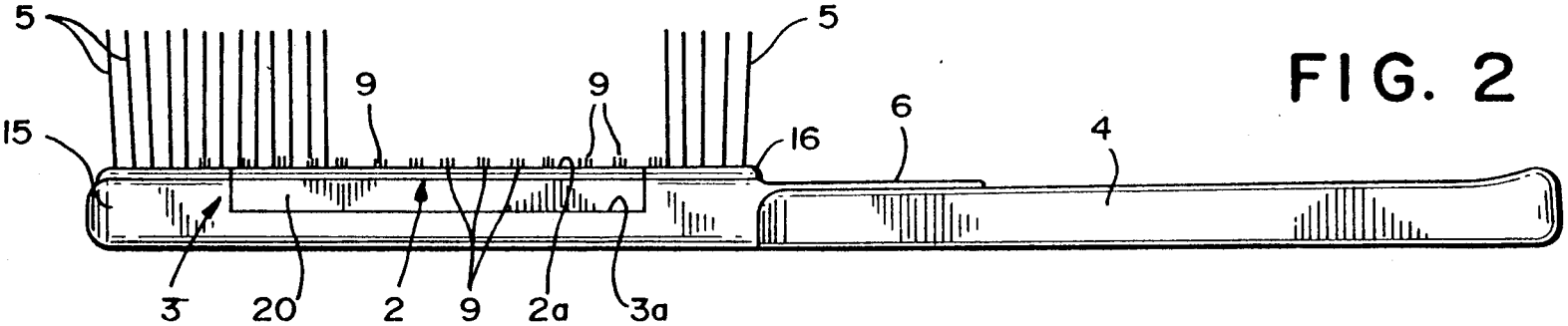
FIG. 2 is a side elevation.
Figure 3:
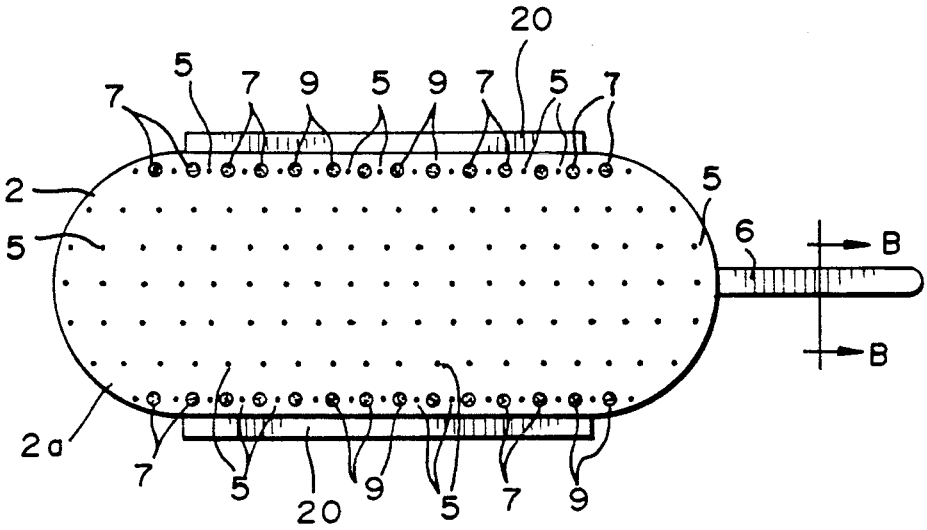
FIG. 3 is a plan view of a brush base.
Figure 4:
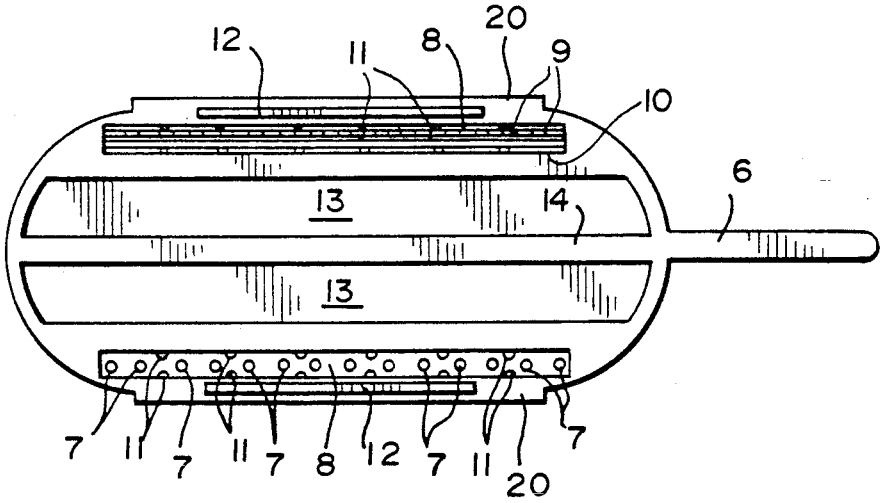
FIG. 4 is a rear view partly omitted and showing the brush base.
Figure 5:
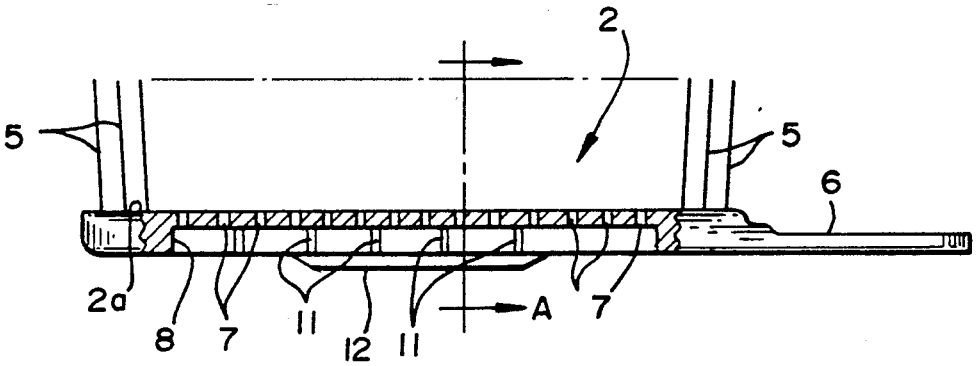
FIG. 5 is a side elevation partly broken away and showing the same.
Figure 6:
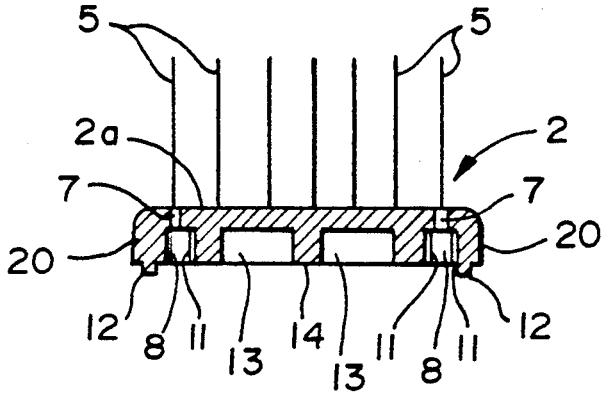
FIG. 6 is a view in section taken along the line A—A in FIG. 5.
Figure 7:
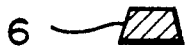
FIG. 7 is an enlarged view in section taken along the line B—B in FIG. 3.
Figure 10:
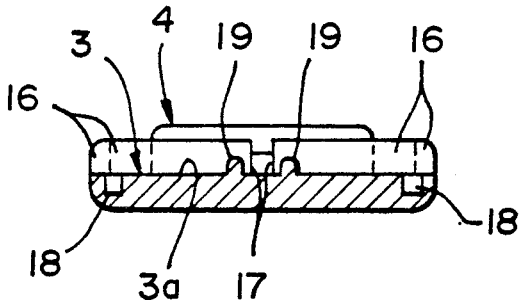
FIG. 10 is a view in section taken along the line D—D in FIG. 8.
Figure 8:
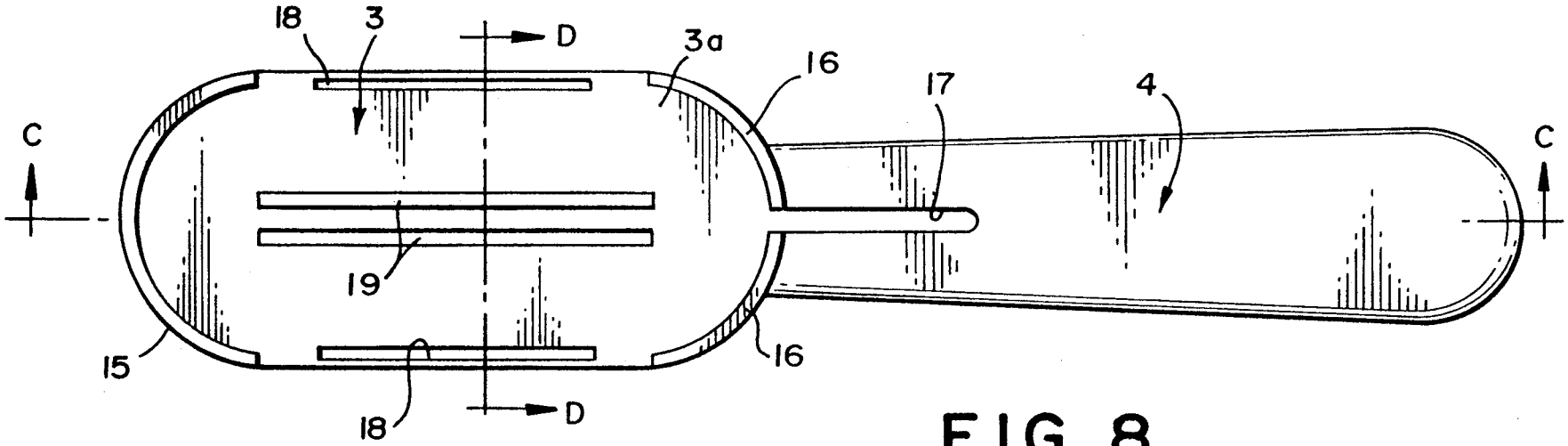
FIG. 8 is a plan view of the handle.
Figure 9:
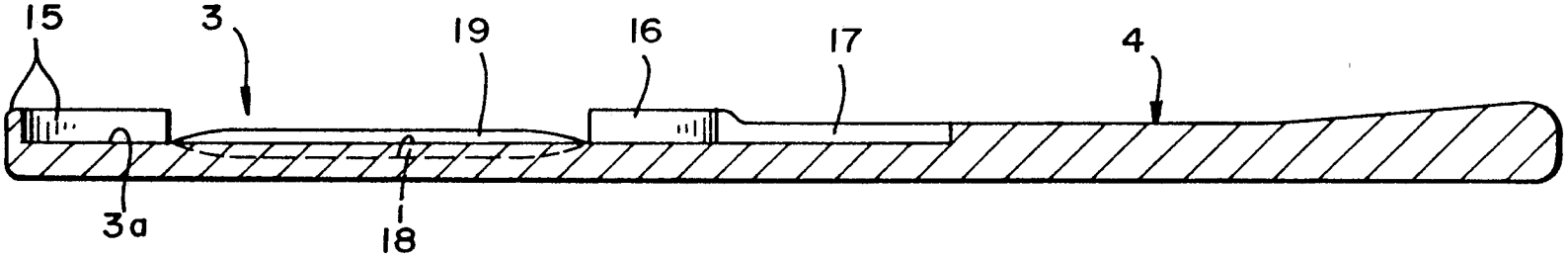
FIG. 9 is a view in section taken along the line C—C in FIG. 8.

The handle 4 is molded of ABS or like synthetic resin, and approximately half thereof in the longitudinal direction serves as the mount 3 for the brush base 2. As shown in FIGS. 8 to 10, the mount 3 is provided with circular-arc engaging walls 15, 16 at its longitudinally opposite ends. A dovetail groove 17 having a trapezoidal cross section with a smaller width at its top for the grounding piece to fit in is formed in the midportion of the fitting wall 16 at the center of the handle 4 and in the surface of the handle 4. The mount 3 is formed in its surface 3*a* with grooves 18 corresponding to the respective fitting ridges 12 on the brush base 2 and has on the surface engaging ridges 19 for holding the fitting ridge 14 on its widthwise opposite sides. Additionally, as can be seen in FIGS. 3 and 4, the brush base 2 has a projecting side wall portion 20 at each side thereof. These side wall portions 20 extend between the engaging walls 15, 16 so as to have an exposed outer surface that lies flush with the outer surface of the mount 3 at widthwise opposite sides of the brush (see FIGS. 1 and 2).

Figure 11:
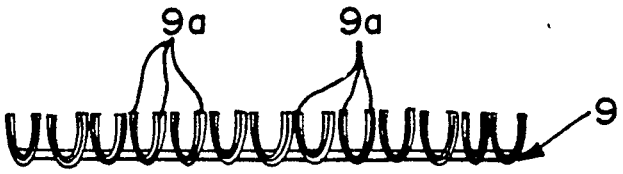
FIG. 11 is a side elevation of an antistatic member.

The antistatic member 9 is made of electrically conductive fibers of a metal (such as copper, nickel or stainless steel), fibers having copper or like metal deposited on the surface thereof by vacuum evaporation, or acrylic fibers having adsorbed monovalent copper ion and having metallic copper separated out therein by reduction, or carbon compound synthetic fibers. As seen in FIG. 11, U-shaped bundles 9*a* of such fibers are stitched together approximately at their bent portions generally into a strip having a base portion. The tips of the fiber bundles 9*a* are inserted through the groove 8 in the brush base 2 and through the small holes 7, and are projected beyond the surface 2*a* of the brush base 2 by a small length (preferably by 1 to 2 mm) required for preventing charging.

After insertion of the fiber bundles 9*a* through groove 8 and small holes 7, each antistatic member is fixed therein via a respective one of the rod-like fixing members 10. As can be seen at the top of FIG. 4, a fixing member 10 is inset in a space between the inner side of the groove 8 (where it engages the projections 11 thereon) and the base portion of the antistatic member 9, the opposite side of which engages the projections 11 on the outer side of groove 8.

When the brush of the above construction is used for brushing hair with the handle 4 of the brush 1 gripped by hand, the grounding piece 6 will be in contact with at least one finger. Thus, static electricity acquired by the bristles 5, owing to friction between the bristles 5 and the hair, can be released through the grounding piece 6. Similarly, as will be appreciated, if the brush is gripped by the mount 3 instead of the handle, the user's thumb and fingers will contact one or both of the side wall portions 20 of the electrically conductive base 2, so that acquired static electricity still can be released.

Although the brush base 2 and the handle 4 are separately molded and assembled into the brush 1 according to the above embodiment, the brush base 2 and the handle 4 can be molded integrally.

Further according to the embodiment, the brush base 2 can be fixedly connected to the handle 4 for assembly merely by inserting the grounding piece 6 into the dovetail groove 17 and thereafter fitting the brush base 2 into the space between the engaging walls 15, 16 on the mount 3, with the fitting ridges 12, 14 fitted respectively into the grooves 18 and into the space between the engaging ridges 19, but the base can be fixed to the handle by other fixing means, such as an adhesive.

INDUSTRIAL APPLICATION

The hair brush of the present invention is usable for brushing and arranging hair.

I claim:

1. A hair brush comprising an electrically conductive brush base, a handle, a multiplicity of electrically conductive bristles provided upright on the surface of the brush base, and an antistatic member made of electrically conductive fiber and provided at each of widthwise opposite end portions of the brush base surface running longitudinally of the brush base; wherein the handle has a mount toward one end in the longitudinal direction thereof, and the conductive brush base is fitted to the mount; a multiplicity of small holes are formed in the brush base at each widthwise end portion thereof and arranged at a spacing in a row longitudinally of the base, the antistatic member being so provided as to project from the multiplicity of small holes slightly beyond the surface; and wherein the small holes communicate at the rear side thereof with an elongated groove formed in the rear surface of the brush base, and the antistatic member is fitted at its base portion in the groove, a barlike fixing member being inserted between the inner wall defining the groove and the base portion of the antistatic member to fix the antistatic member.

2. A hair brush as defined in claim 1, wherein the brush base is made of a material prepared by admixing carbon with polyester elastomer or like synthetic resin, and the handle is molded of ABS or like synthetic resin, the antistatic member being made of an electrically conductive metal fiber, fiber having copper or like metal deposited on the surface thereof by vacuum evaporation, or acrylic fiber having adsorbed monovalent copper ion and having metallic copper separated out therein by reduction.

3. A hair brush as defined in claim 1, wherein the bristles are formed integrally with the brush base.

4. A hair brush as defined in claim 1, wherein a bar-like grounding piece extends from longitudinal one end of the brush base, and the handle is formed with a dovetail groove corresponding to the grounding piece, the grounding piece being fitted in the dovetail groove so as to be exposed at the surface of the handle.

5. A hair brush as defined in claim 4, wherein the multiplicity of small holes and the bristles in a row at each widthwise end of the conductive brush base are arranged alternatively in a row.

6. A hair brush as defined in claim 1 wherein the top end of the antistatic member is projected through the small holes to a level 1 to 2 mm above the surface of the brush base.

7. A hair brush as defined in claim 6, wherein the mount is provided with engaging walls at its opposite ends in the longitudinal direction thereof, and the conductive brush base is fitted in the space between the engaging walls.

8. A hair brush as defined in claim 7, wherein a fitting ridge is provided at each of the widthwise outer ends of the conductive brush base, and the mount (3) is formed in its surface with a groove corresponding to the ridge, the ridge being fitted in the groove.

9. A hair brush according to claim 1, wherein the electrically conductive brush base has a projecting side wall portion at each said widthwise end portion thereof, each said side wall portion having an exposed outer surface that lies flush with an outer surface of the mount at widthwise opposite sides of the brush.

10. A hair brush according to claim 7, wherein the electrically conductive brush base has a projecting side wall portion at each said widthwise end portion thereof, each said side wall portion extending between the engaging walls so as to have an exposed outer surface that lies flush with an outer surface of the mount at widthwise opposite sides of the brush.

* * * * *